US005196157A

United States Patent [19]

Inoue et al.

[11] Patent Number: 5,196,157

[45] Date of Patent: Mar. 23, 1993

[54] TUNDISH EXCHANGE APPARATUS FOR A CONTINUOUS CASTING EQUIPMENT

[75] Inventors: Takao Inoue; Hiroshi Shamoto, both of Nara, Japan

[73] Assignee: Hitachi Zosen Corporation, Osaka, Japan

[21] Appl. No.: 927,875

[22] Filed: Aug. 10, 1992

Related U.S. Application Data

[63] Continuation of Ser. No. 718,947, Jun. 21, 1991, abandoned.

[30] Foreign Application Priority Data

Jun. 28, 1990 [JP] Japan ..... 2-68952[U]

[51] Int. Cl.[5] ..... B22D 11/10; B22D 41/12

[52] U.S. Cl. ..... 266/143; 164/438; 266/165; 266/276

[58] Field of Search ..... 164/438, 337, 335; 222/591; 266/143, 165, 276

[56] References Cited

U.S. PATENT DOCUMENTS

| | | | |
|---|---|---|---|
| 1,866,668 | 7/1932 | Protzeller et al. | 266/276 X |
| 3,344,847 | 10/1967 | Beemer | 164/438 X |
| 3,558,256 | 1/1971 | Bick et al. | 164/438 X |
| 3,773,103 | 11/1973 | Burkhardt et al. | 164/438 X |
| 3,773,228 | 11/1973 | Koch et al. | 164/438 X |
| 3,810,507 | 5/1974 | Schoffmann et al. | 164/438 X |
| 3,866,665 | 2/1975 | Schoffmann | 164/438 X |
| 3,894,576 | 7/1975 | Schoffmann | 164/438 X |
| 4,215,854 | 8/1980 | Lustenberger | 266/276 X |
| 4,978,105 | 12/1990 | Meierling | 266/143 |

FOREIGN PATENT DOCUMENTS

| | | | |
|---|---|---|---|
| 52-33049 | 8/1977 | Japan | 164/438 |
| 59-50966 | 3/1984 | Japan | 266/165 |
| 323186 | 2/1972 | U.S.S.R. | 164/438 |
| 1006546 | 10/1965 | United Kingdom | 266/143 |

*Primary Examiner*—J. Reed Batten, Jr.
*Attorney, Agent, or Firm*—Joseph W. Farley

[57] ABSTRACT

Two tundish cars, each detachably carrying a tundish, are supported on continuous circular rails for movement between a pouring position and a standby position spaced along the rails from a pouring position and provided with guide rails mounted above the circular rails and extending radially outwardly therefrom to a slag discharge position and to tundish reconditioning apparatus, both spaced radially outwardly of the circular rails. A shuttle truck moveable along the guide rails and provided with a hoist, lifts a tundish from its car in the standby position, transports the lifted tundish to the slag discharge position, to the reconditioning apparatus, and returns the emptied, reconditioned tundish to its car.

1 Claim, 6 Drawing Sheets

B
C
30
25
28
29
30
31
32
24
26
11
27
D
E
36
f
14
19
18
12
31
32
24
G
11
e
18
12
15
19

31
32
35
33
34
24

TUNDISH EXCHANGE APPARATUS FOR A CONTINUOUS CASTING EQUIPMENT

This is a continuation of copending application Ser. No. 07/718,947 filed on Jun. 21, 1991 and now abandoned.

FIELD OF THE INVENTION

The present invention relates to a tundish exchange apparatus for a continuous casting equipment for receiving molten steel from a ladle into a tundish and supplying it to a mold.

BACKGROUND OF THE INVENTION

A pouring position is a position where the molten steel is poured into a tundish and is allowed to flow therefrom to a mold. It is most common to interpose the pouring position between two stand-by positions in such a manner that these three positions lie on a straight course. Two tundish cars movable along a traveling rail are provided so that, for example, a tundish car is moved from one side toward the pouring position, molten steel is received into a tundish from a ladle, and the molten steel is poured into a mold through a sliding nozzle. After the pouring work ends, the tundish car is returned toward the stand-by position and then another tundish car on the other side is moved to the pouring position for working. At the stand-by positions are disposed residual steel and slag discharge apparatus, sliding nozzle exchange apparatus, and preheating apparatus for the tundishes respectively, so that residual steel and slag in the tundishes are discharged therefrom to repair inner walls thereof and each sliding nozzle is exchanged and the tundishes are preheated.

In such construction, the residual steel and slag discharge apparatus is required for the respective stand-by positions, thereby creating the problem in that the cost of equipment becomes high.

In addition, since the work of draining the residual steel and slag from a tundish is done in the stand-by positions, there is always a possibility that the residual steel and slag spilled on the track may obstruct the passage of tundish cars.

SUMMARY OF THE INVENTION

It is therefore an object of the present invention to provide a tundish exchange apparatus by which the work of draining the residual steel and slag from a tundish can be done in a position radially departing from the turning circle of the tundish.

This object is accomplished by providing a tundish exchange apparatus comprising:

- two tundishes adapted to move along one and the same turning circle;
- a casting station disposed in one position along said turning circle and provided with a casting mold;
- an elevated support beam extending radially outwardly from, and in another position along, said turning circle;
- two parallel guide rails laid on said support beam;
- a truck adapted to run on said guide rails; and means for hoisting one of said two tundishes from said turning circle so as to allow said one tundish to be held on an underside of said truck, moved radially outwardly from said turning circle to a position allotted for doing the work of draining the residual steel and slag from a tundish, returned to a position over said turning circle when the residual steel and slag have been drained, and lowered to said turning circle.

The present invention serves to eliminate the possibility that the residual steel and slag may be spilled on the track and may throw impediments in the way of tundish cars.

The present invention permits the uninterrupted operation of a continuous casting apparatus even when the work of draining the residual steel and slag from a tundish is prolonged in the position allotted for doing that work, because a new tundish can be placed on the turning circle in place of one which has been hoisted from the turning circle and moved to the position allotted for doing the above-mentioned work.

The above and further objects and novel features of the invention will fully appear from the following detailed description when the same is read in connection with the accompanying drawings.

DESCRIPTION OF A PREFERRED EMBODIMENT

A comparison of the present invention with the prior art will help make the features of the former conspicuous.

Figure 7:
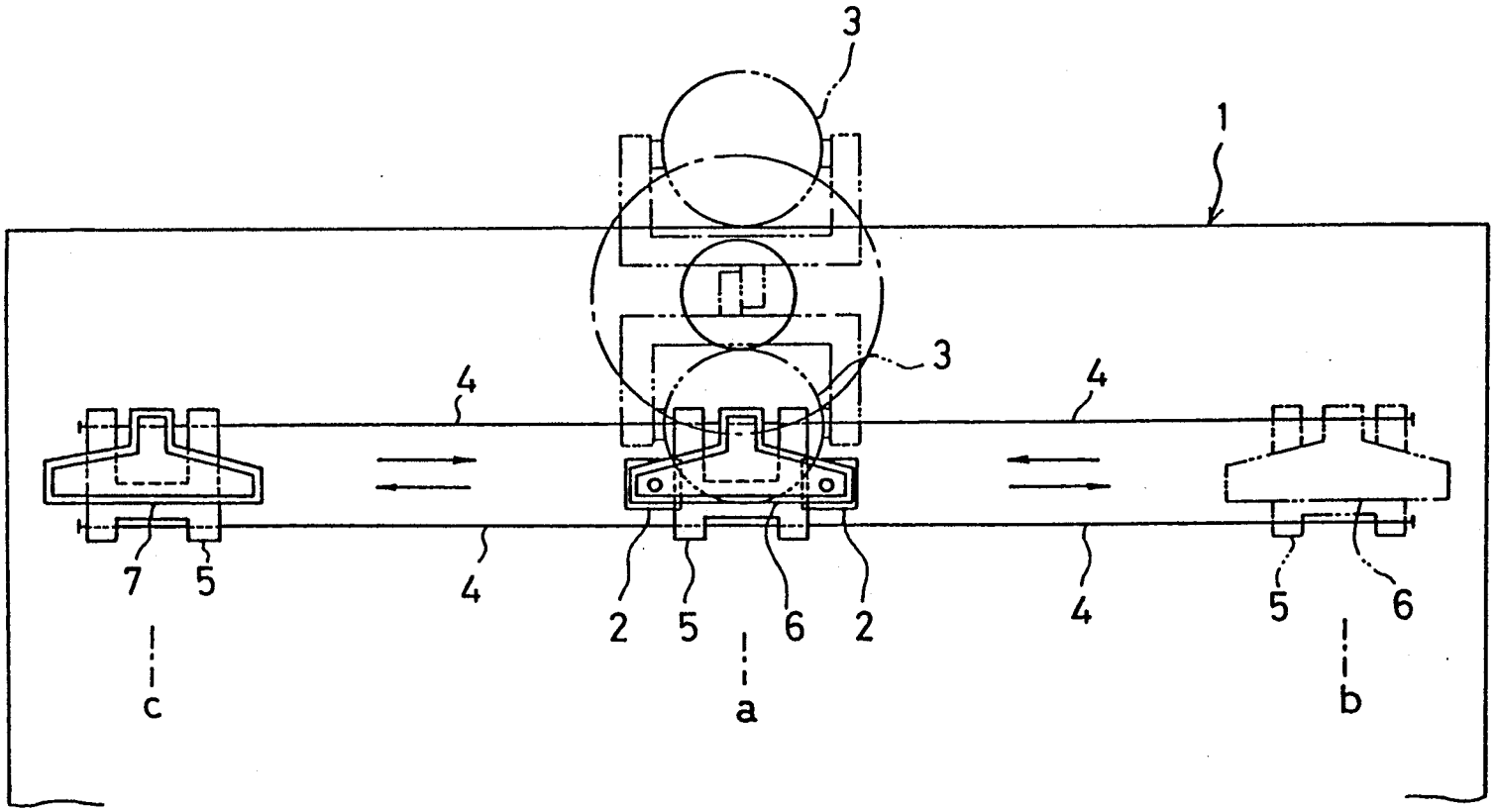
FIG. 7 PRIOR ART
FIG. 7 is a general plan view of the conventional tundish exchange apparatus.

In case of the prior art apparatus shown in FIG. 7, a pouring position (a) is interposed between two stand-by positions (b) and (c) in such a manner that these three positions lie on a straight course. Two tundish cars 5 movable on traveling rails 4 are provided, so that, for example, the tundish car 5 is moved from the right side in the drawing toward the molten steel pouring position (a), molten steel is received into a tundish 6 from the ladle 3, and the molten steel is poured into a mole 2 through sliding nozzles. After the pouring work ends, the tundish car 5 is returned toward the stand-by position (b) and then the car 5 at the left side is moved to the pouring position (a) for working. At the stand-by positions (b) and (c) are disposed residual steel and slag discharge apparatus, sliding nozzle exchange apparatus, and preheating apparatus for the tundishes 6 and 7 respectively, so that residual steel and slag in the tundishes 6 and 7 are discharged therefrom to repair inner walls thereof and each sliding nozzle is exchanged and the tundishes 6 and 7 and preheated.

Next, a fist embodiment of a tundish exchange apparatus of the present invention will be explained in accordance with FIGS. 1 through 4.

Figure 1:
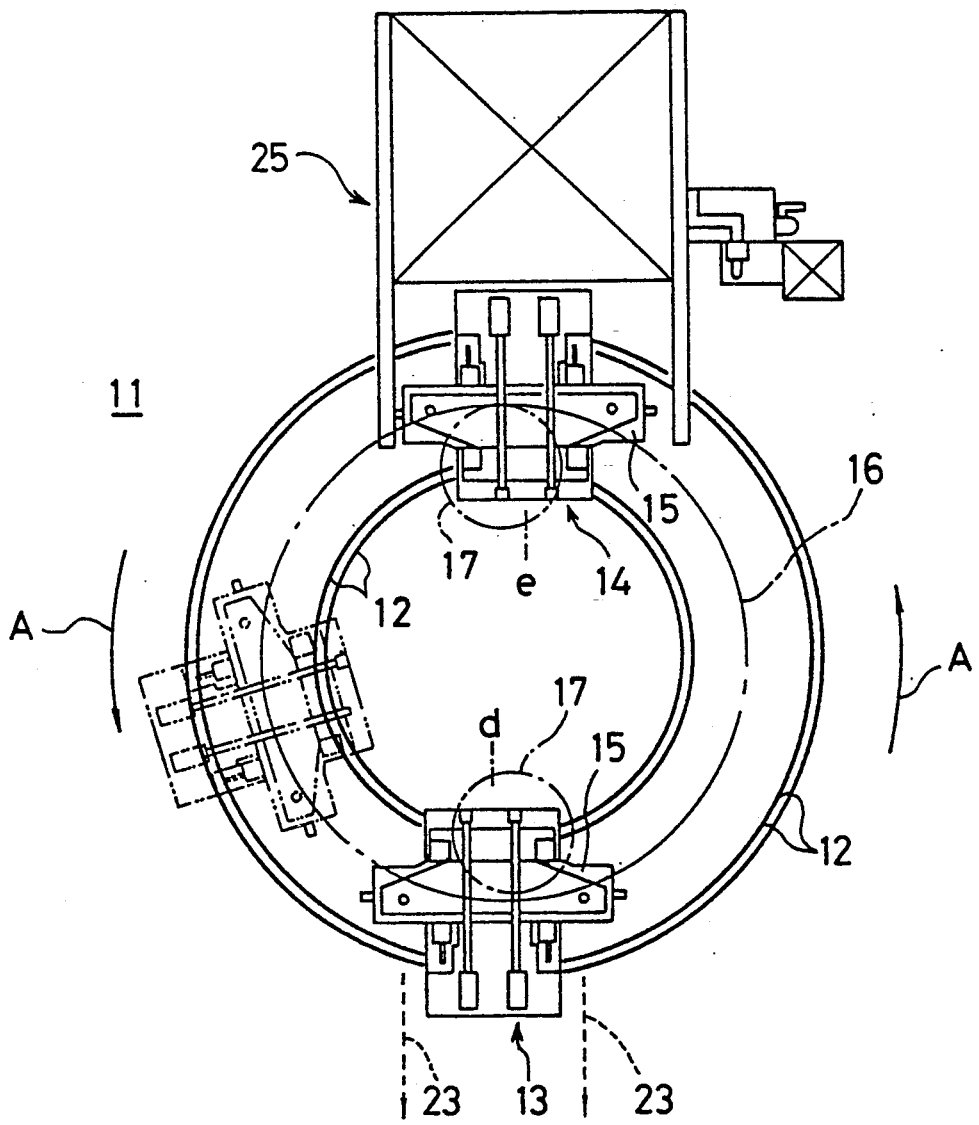
FIG. 1 is a general plan view of a first embodiment of a tundish exchange apparatus of the present invention.

As shown in FIG. 1, a pair of inside and outside circular traveling rails 12 are disposed on a wording floor 11, and on the rails 12 are movably guided first and second tundish cars 13 and 14. Tundishes 15 are detachably loaded on the first and second tundish cars 13 and 14 respectively and are movable in the direction of the arrow A between the molten steel pouring position (d) and the stand-by position (e) of tundish 15 symmetrical with the position (d) on the traveling rails 12 (a circular route 16). Ladles 17 disposed above the pouring position (d) and stand-by position (e) are alternately used by a turret (not shown) revolvable coaxially with the traveling rails 12.

At the stand-by position (e) or between the stand-by position (e) and the pouring position (d), for example, at the position as shown by the two-dot chain line in FIG. 1, one tundish 15 is prepoured therein with molten steel and, when the pouring into the mold 20 from the other tundish 15 is finished, the other tundish 15 is immediately moved in the direction of the arrow A and thereafter the one tundish 15 is moved toward the pouring position (d) and simultaneously therewith the pouring into the mold 20 is adapted to enable the pouring to start. Thus, when such operation is compared with the conventional operation that, just after an empty tundish 15 reaches the pouring position (d), the ladle 17 provided thereat pours the molten steel into the tundish 15, a working time can be reduced to that extent.

Figure 2:
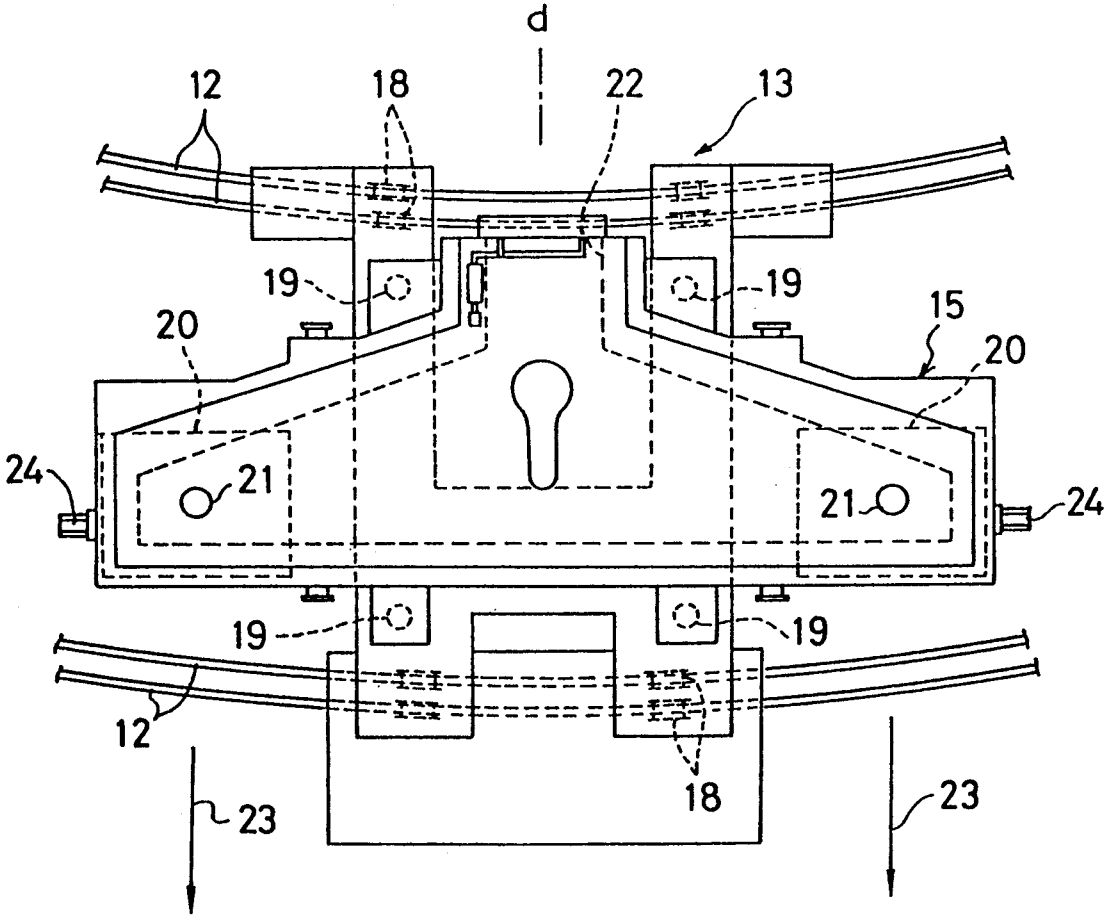
FIG. 2 is a plan view of a tundish car used in the first embodiment.

Referring to FIG. 2, the first and second tundish cars 13 and 14 each have traveling wheels 18 guided on the traveling rails 12, and support jacks 19 are upwardly disposed at four front, back, leftward and rightward positions, thereby supporting the tundish 15 vertically movably from below. The tundish 15 is approximately rectangular, extending tangentially of the traveling rails 12 when viewed in plane, is provided at the bottom with a pair of left and right sliding nozzles 21 corresponding to the mold 20 and has an overflow weir 22 extending inwardly from the central portion and being open. In addition, reference numeral 23 designates the forward moving direction of a strand from the mold 20. At both lateral ends are projecting hanging shafts 24 regular-octagonal in section. The hanging shafts 24, when viewed radially of the traveling rail 12, are disposed outwardly of the center G of gravity (in FIG. 3) of tundish 15 with respect to the rails 12.

Figure 3:
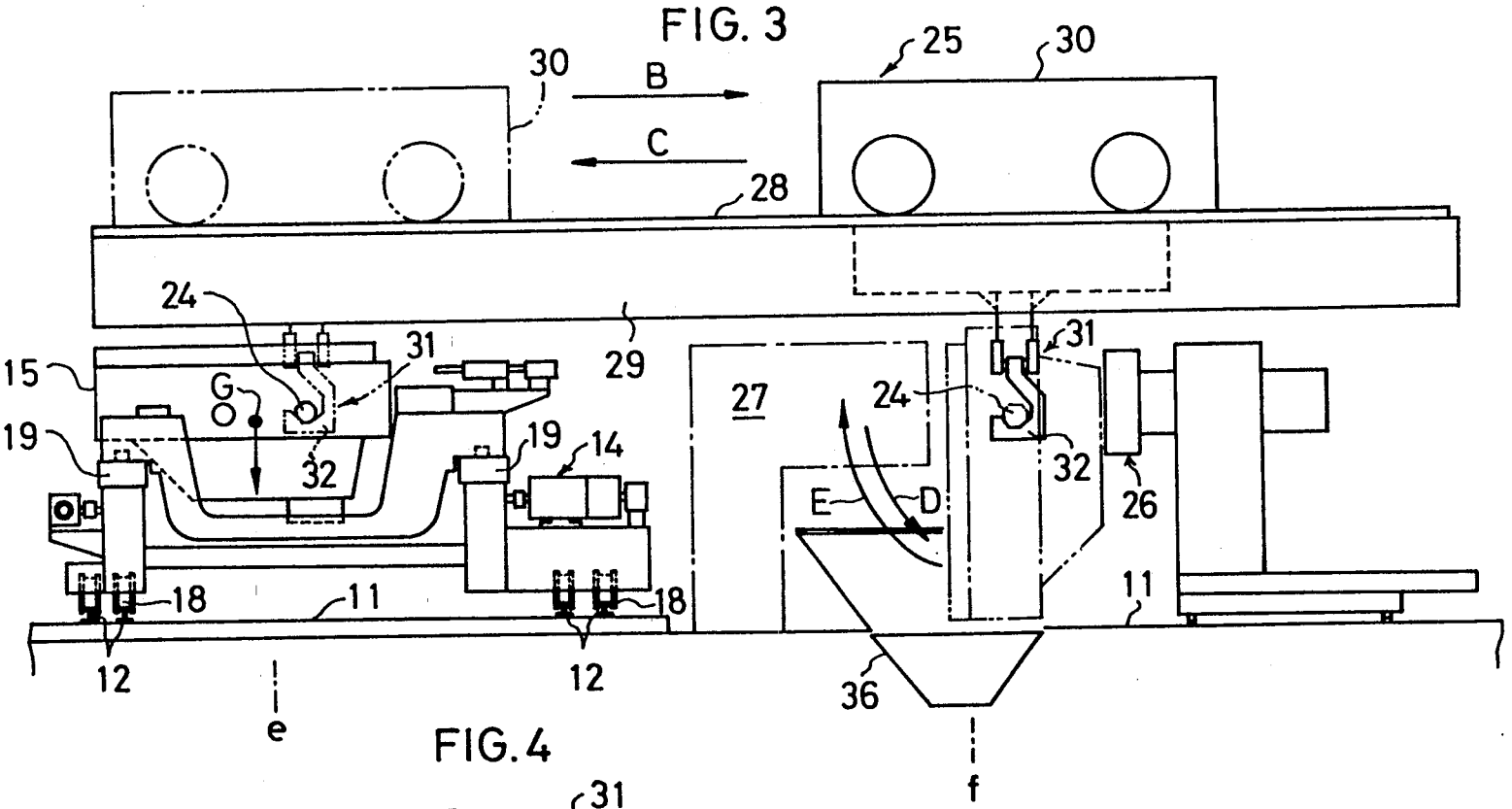
FIG. 3 is a side view of a residual steel and slag discharge apparatus used in the same.
Figure 4:
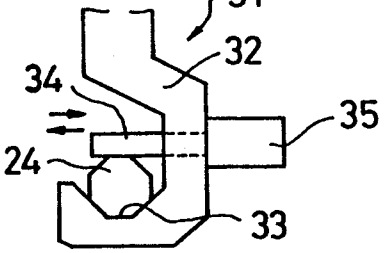
FIG. 4 is a side view of a hanger used in the same.

At the stand-by position (e) are disposed a residual steel and slag discharge apparatus 25, a sliding nozzle exchange apparatus 26 and a repair and preheating apparatus 27. At the residual steel and slag discharge apparatus 25, as shown in FIG. 3, a pair of left and right guide rails 28 extending radially outwardly of the traveling rails 12 from above the stand-by position (e) are disposed on a support beam 29, a self-traveling system slanted turntable truck 30 being movably disposed on the guide rails 28. At the same slant turntable truck 30 are vertically movably provided a pair of left and right hangers 31 for engaging or disengaging therewith or therefrom the hanging shafts 24 of tundish 15. At the hangers 31, as shown in FIG. 4, a retainer 33 of a hook 32 open at the stand-by position (e) is angularly formed corresponding to the hanging shaft 24 and a fixing pin 34 for pressing the upper surface of hanging shaft 24 is provided at the upper portion of the retainer 33 and is advanced or retracted by an engaging or disengaging cylinder 35. Also, at the slant turntable truck 30 is provided an attitude return apparatus for returning the tundish 15 from its vertical to horizontal attitude, the attitude return apparatus is not shown, but the tundish 15 is hooked to be lifted by a winch for rotation.

Accordingly, for example, the slant turntable truck 30 is moved to the stand-by position (e) where the second tundish car 15 reaches, each hook 32 is engaged with one hanging shaft 24, the engaging or disengaging cylinder 35 allows the fixing pin 34 to project to press the upper surface of hanging shaft 24, the tundish 15 is lifted in the horizontal attitude while preventing the tundish 15 from rotation so as to be carried to the residual slag discharge position (f) and retract the fixing pin 34, whereby the tundish 15 is turned by an angle of 90° from its horizontal attitude to the vertical attitude so as to enable the slag to be discharged from the overflow weir 22 (in FIG. 2) to a slag discharge pot 36.

On the working floor 11 in the vicinity of the slag discharge position (f) are disposed the sliding nozzle exchange apparatus 26 and a repair and preheating apparatus 27 having a dry preheating nozzle, by which the inner wall of tundish 15 is repaired after the residual steel and slag are discharged, the sliding nozzles 21 (in FIG. 2) are exchanged, and the tundish 15 is preheated to be ready for the next use.

The tundish 15 after the preheating is restored from its vertical attitude to the horizontal and the slant turntable truck 30 is moved from the steel and slag discharge position to the stand-by position so as to be reloaded on the second tundish car 14.

The second tundish car 14, when an exchange period nears, is premoved to the vicinity of the molten steel pouring position (d) shown by the phantom line in FIG. 1, whereby the tundish can rapidly be exchanged so as to demonstrate the effect on the continuous casting of the different kind of steel.

Figure 5:
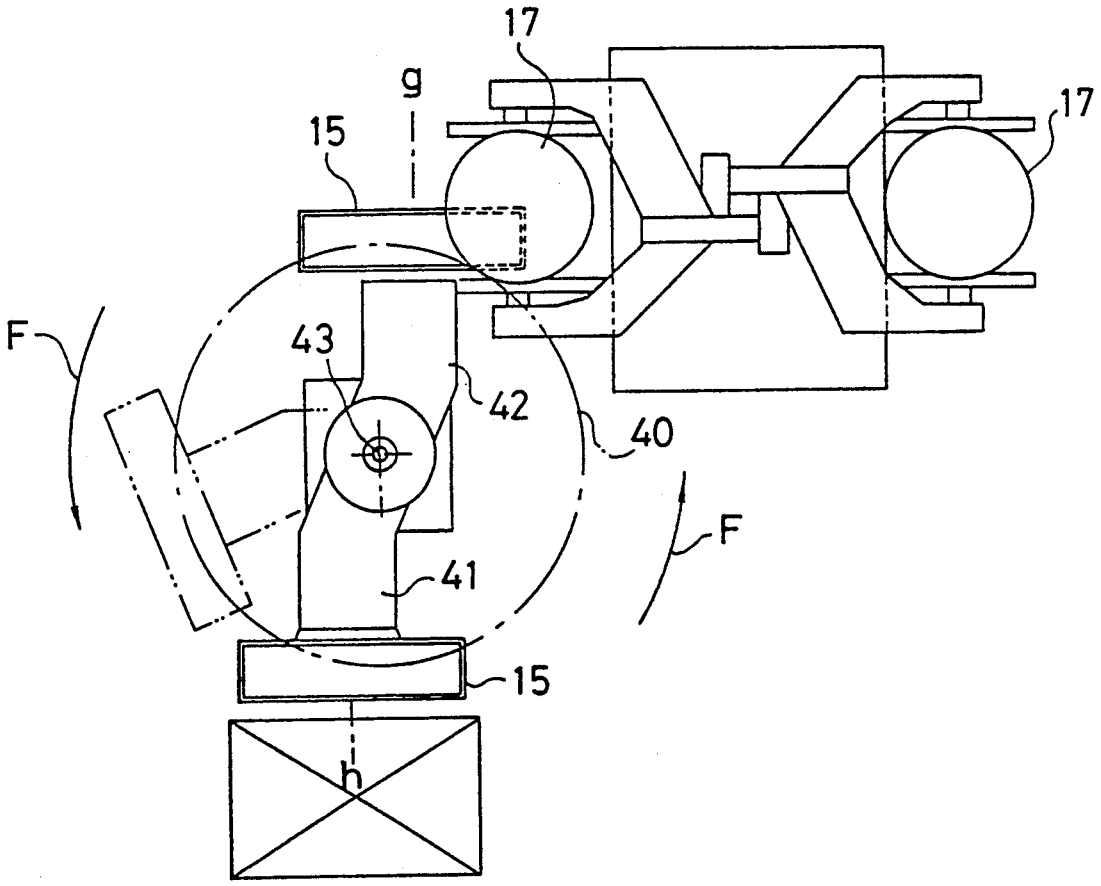
FIG. 5 is a general plan view of a second embodiment of the tundish exchange apparatus of the present invention.
Figure 6:
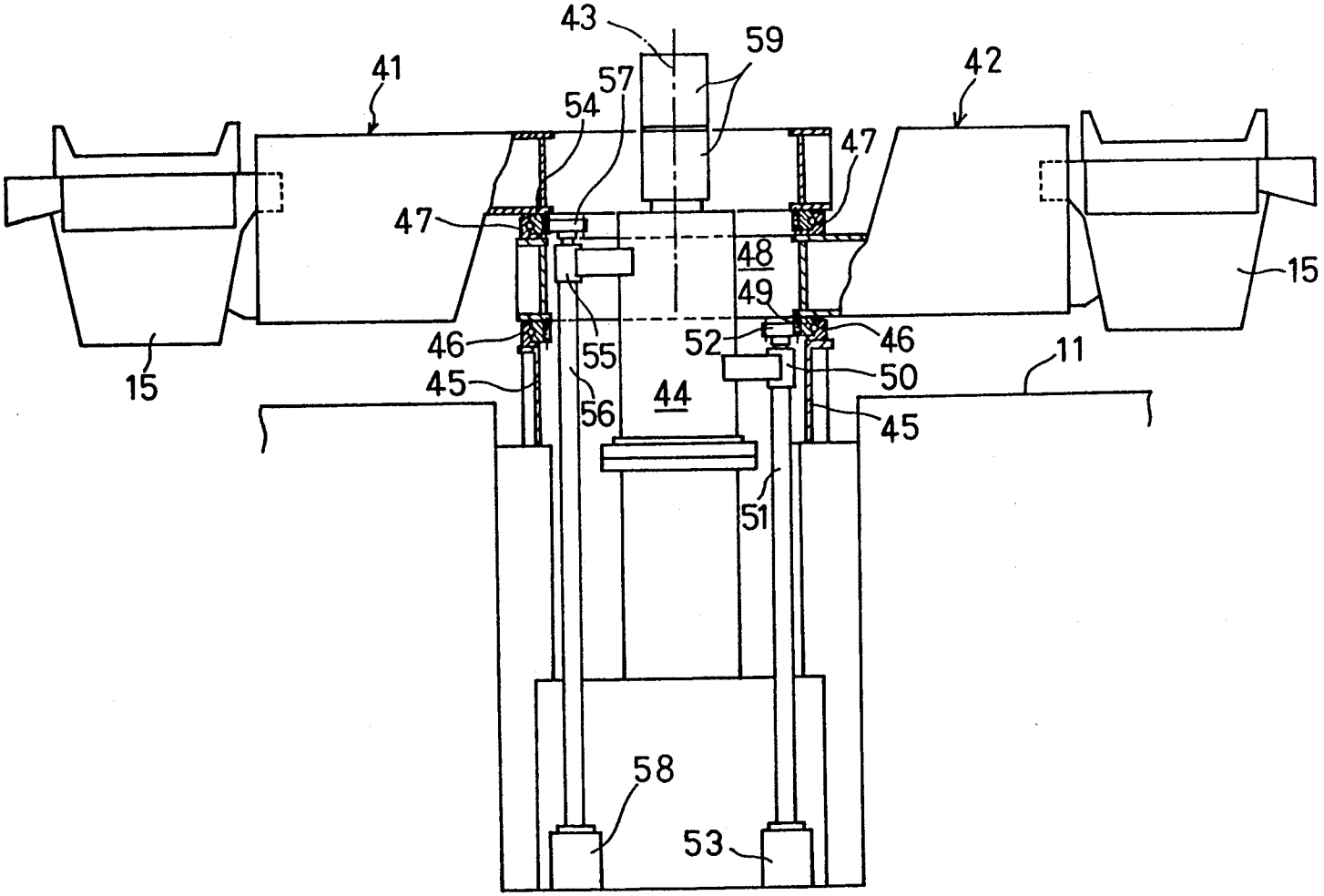
FIG. 6 is a sectional side view of the second embodiment.

Referring to FIGS. 5 and 6, a second embodiment of the tundish exchange apparatus for the continuous casting apparatus of the invention is shown, which is so constructed that two first and second whirling arms 41 and 42 detachably loading at their utmost ends the tundishes 15 are disposed revolvably around the same vertical axis 43, the molten steel pouring station (g) provided with a mold is provided at the predetermined position on a whirling route 40 through which the tundish 15 moves, and the stand-by station (h) provided with a residual steel and slag discharge apparatus is positioned symmetrically with the pouring station (g) with respect to the vertical axis.

In other words, a ring-like-shaped pedestal 45 is disposed around a vertical support pole 44 erected on a working floor 11, and on the pedestal 45 are rotatably supported the roots of the first and second whirling arms 41 and 42 through bearings 46 and 47 respectively. At the root of the second whirling arm 42 is formed a ring-like-shaped space 48 around the vertical support pole 44, and a second ring gear 49 is mounted at the bottom of the outer periphery of the space 48. A second driving gear 52 engageable with the second ring gear 49 is mounted to a second driving shaft 51 which is vertically provided between the vertical support pole 44 and the pedestal 45 and is supported by the vertical support pole 44 through a bearing 50, so that the second whirling arm 42 is whirled by a second whirling motor 53 connected to the second driving shaft 51. On the other hand, a first ring gear 54 is mounted at the bottom of the root of the first whirling arm 41, a first driving gear 57 engageable with the first ring gear 54 is mounted to a first driving shaft 56 which is vertically provided between the vertical support pole 44 and the pedestal 45 is supported by the vertical pole 44 through a bearing 55 in the space 48, so that the first whirling arm 41 is whirled by a first whirling motor 58 connected to the first driving shaft 56. In addition, at the upper portion of the vertical support pole 44 are disposed rotary joints 59 for supplying a drive source or the like to the respective tundishes 15.

At the steel and slag discharge position are provided, not shown but as well-known in the art, the residual steel and slag discharge apparatus which discharges the residual steel and slag while loading the tundishes 15 on the whirling arms 41 and 42 or hanging them to be slanted, and their apparatus and preheating apparatus for the tundish.

As seen from the above, the tundish exchange apparatus of the present invention can move the tundishes on the endless route or the whirling route by the tundish cars or the whirling arms, whereby one stand-by position only is needed so as to enable the cost of equipment to be reduced by half in comparison with the conventional apparatus. Moreover, the tundish after discharging therefrom the residual steel and slag and being repaired and preheated, when near the tundish exchange, stands by in the vicinity of the molten steel pouring position by moving the tundish car or by whirling the whirling arm, whereby the tundish can quickly be exchanged so as to be effective in the continuous casting of different kinds of steel.

Although several embodiments have been described, they are merely exemplary of the invention and not to be constructed as limiting, the invention being defined solely by the appended claims.

What is claimed is:

1. A tundish apparatus for a continuous casting equipment, comprising two tundishes, first and second tundish cars each provided with means for detachably carrying one of said tundishes, continuous circular rail means supporting said tundish cars for moment between a pouring position and a standby position spaced along said rail means from said pouring position, a pair of guide rails mounted above said circular rail means at said standby position, said guide rails extending radially outwardly from said circular rail means to a slag discharge position spaced from said circular rail means and provided with a slag receiving pot;

tundish reconditioning apparatus mounted below said pair of guide rails adjacent to said slag discharge position and radially outwardly of said circular rail means, a truck moveable along said guide rails between said standby position and said slag discharge position, and hoisting means carried by said truck for lifting one of said two tundishes from one of said first and second tundish cars in said standby position, and transporting said one tundish to said slag discharge position for the discharge of slag into said slag receiving pot, to said tundish reconditioning apparatus, and back to said standby position for reloading on the one of said first and second tundish cars therein.

* * * * *

UNITED STATES PATENT AND TRADEMARK OFFICE

CERTIFICATE OF CORRECTION

PATENT NO. : 5,196,157

DATED : March 23, 1993

INVENTOR(S) : Takao Inoue et al.

It is certified that error appears in the above-identified patent and that said Letters Patent is hereby corrected as shown below:

Column 2, line 50, "mole" should read --mold--;

Column 2, line 66, "wording" should read --working--.

Column 4, line 35, "utmost" should read --outmost--;

Column 4, line 64, after "45" insert --and--.

Column 5, line 9, "their" should read --the repair--.

Signed and Sealed this

Sixteenth Day of November, 1993

*Attest:*

Bruce Lehman

BRUCE LEHMAN

*Attesting Officer*

*Commissioner of Patents and Trademarks*